US008427341B2

(12) United States Patent
Yulevich

(10) Patent No.: US 8,427,341 B2
(45) Date of Patent: Apr. 23, 2013

(54) SYSTEM AND METHOD FOR PROVIDING ROAD INFORMATION IN ADVANCE

(76) Inventor: Yonatan Yulevich, Tel Aviv (IL)

( * ) Notice: Subject to any disclaimer, the term of this patent is extended or adjusted under 35 U.S.C. 154(b) by 306 days.

(21) Appl. No.: 12/178,667

(22) Filed: Jul. 24, 2008

(65) Prior Publication Data

US 2009/0027176 A1 Jan. 29, 2009

Related U.S. Application Data

(60) Provisional application No. 60/952,574, filed on Jul. 29, 2007.

(51) Int. Cl.
*G08G 1/09* (2006.01)

(52) U.S. Cl.
USPC ..... 340/905; 340/901

(58) Field of Classification Search ..... 340/905, 340/901
See application file for complete search history.

(56) References Cited

U.S. PATENT DOCUMENTS 4,408,121 A * 10/1983 Galatha ..... 235/494
5,550,932 A * 8/1996 Blaylock et al. ..... 382/139
5,682,030 A * 10/1997 Kubon ..... 235/462.25
5,819,198 A * 10/1998 Peretz ..... 701/117
5,953,426 A * 9/1999 Windel et al. ..... 380/51
6,107,940 A * 8/2000 Grimm ..... 340/905
6,259,374 B1 * 7/2001 Kisner et al. ..... 340/905
6,466,139 B1 * 10/2002 Schmidt ..... 340/905
6,574,548 B2 * 6/2003 DeKock et al. ..... 701/117
6,967,592 B2 * 11/2005 Bell et al. ..... 340/905
7,109,850 B2 * 9/2006 Kawazoe et al. ..... 340/425.5
7,706,963 B2 * 4/2010 Parikh et al. ..... 701/117
2004/0026511 A1 * 2/2004 Cheung et al. ..... 235/462.1
2004/0196161 A1 * 10/2004 Bell et al. ..... 340/905
2008/0119965 A1 * 5/2008 McCrary ..... 701/2

* cited by examiner

*Primary Examiner* — George Bugg
*Assistant Examiner* — Naomi Small
(74) *Attorney, Agent, or Firm* — Deborah Gador

(57) ABSTRACT

A system for providing a vehicle and/or the driver in advance with road information, the system including at least one message disposed at any point along the road, the message including information of at least one characteristic of an upcoming section of the road, at least one sensor mounted on the vehicle for reading the message, and a device coupled to the sensor for processing the message and providing the information to the vehicle and/or the driver in advance of the vehicle reaching that section of the road.

9 Claims, 4 Drawing Sheets

SYSTEM AND METHOD FOR PROVIDING ROAD INFORMATION IN ADVANCE

FIELD OF THE INVENTION

The present invention relates to reducing driving accidents, in general and, in particular, to preventing road accidents by anticipating dangerous situations for drivers in accordance with road characteristics and driving conditions.

BACKGROUND OF THE INVENTION

Car crashes, also called road traffic accidents or motor vehicle accidents, kill hundreds of thousands of people worldwide each year, and injure about forty times this number. Many crashes are caused by human behavior, by mechanical failure, or by road conditions.

In order to reduce car collisions, traffic signs or road signs at the sides of roads instruct road users and provide them in advance with information regarding approaching road parameters, such as sharp curves, stop signs, etc. International signs use symbols in place of words, to overcome language differences and enhance quick apprehension.

Still, the driver must notice the signs, understand them, analyze the road parameters, and take the proper action. At times, the driver has very little time in which to correctly assess the situation, while an error in judgment may have serious consequences. Thus, providing early information to the driver of road parameters and driving conditions can significantly reduce driving errors, since the driver may have more time to consider the proper action and prevent dangerous situations from being formed.

Another cause of motorcar accidents is driving off the road or crossing lanes during uncontrolled driving, such as when the driver falls asleep.

Accordingly, there is a long felt need for providing drivers in advance with information of a wide variety of road parameters and driving conditions (hereinafter "characteristic or characteristics") for alerting the driver of a potentially dangerous situation, thus mitigating road accidents.

SUMMARY OF THE INVENTION

There is provided according to the present invention a system for providing a vehicle and/or the driver in advance with road information, the system including at least one message disposed at any point along the road, the message including information of at least one characteristic of an upcoming section of the road, at least one sensor mounted on the vehicle for reading the message, and a device coupled to the sensor for processing the message and outputting, in advance, the information to the vehicle and/or the driver, before the vehicle reaches that section of the road. The device may further include a processor. Alternatively, the system recommends to the driver a course of action to reduce the level of risk of the driving. Since most accidents are caused by incorrect or late performance of a required action by the driver to avoid potentially dangerous situations, the sensitivity and improved analysis of the proposed system can prevent many accidents.

According to one embodiment of the invention, the system further includes indications in the vehicle of the information for alerting a driver of the vehicle of the road characteristics at any point along the road.

According to another embodiment, the message is encoded. The code may include a reference symbol defining a top and a bottom of a code line, a maximum height of a code symbol, and the direction of encoding of the code line; and at least one code symbol whose height relative to the reference symbol and whose position relative to the top or bottom of the code line represent information.

There is also provided a method for providing a vehicle and/or the driver in advance with road information. The method includes disposing at least one message along a road, the message including information of at least one characteristic of an upcoming section of the road. The method further includes mounting on the vehicle at least one sensor for reading the message, coupling to the sensor a device for processing the message, and outputting the information to the vehicle and/or to the driver before the vehicle reaches that section of the road.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1:
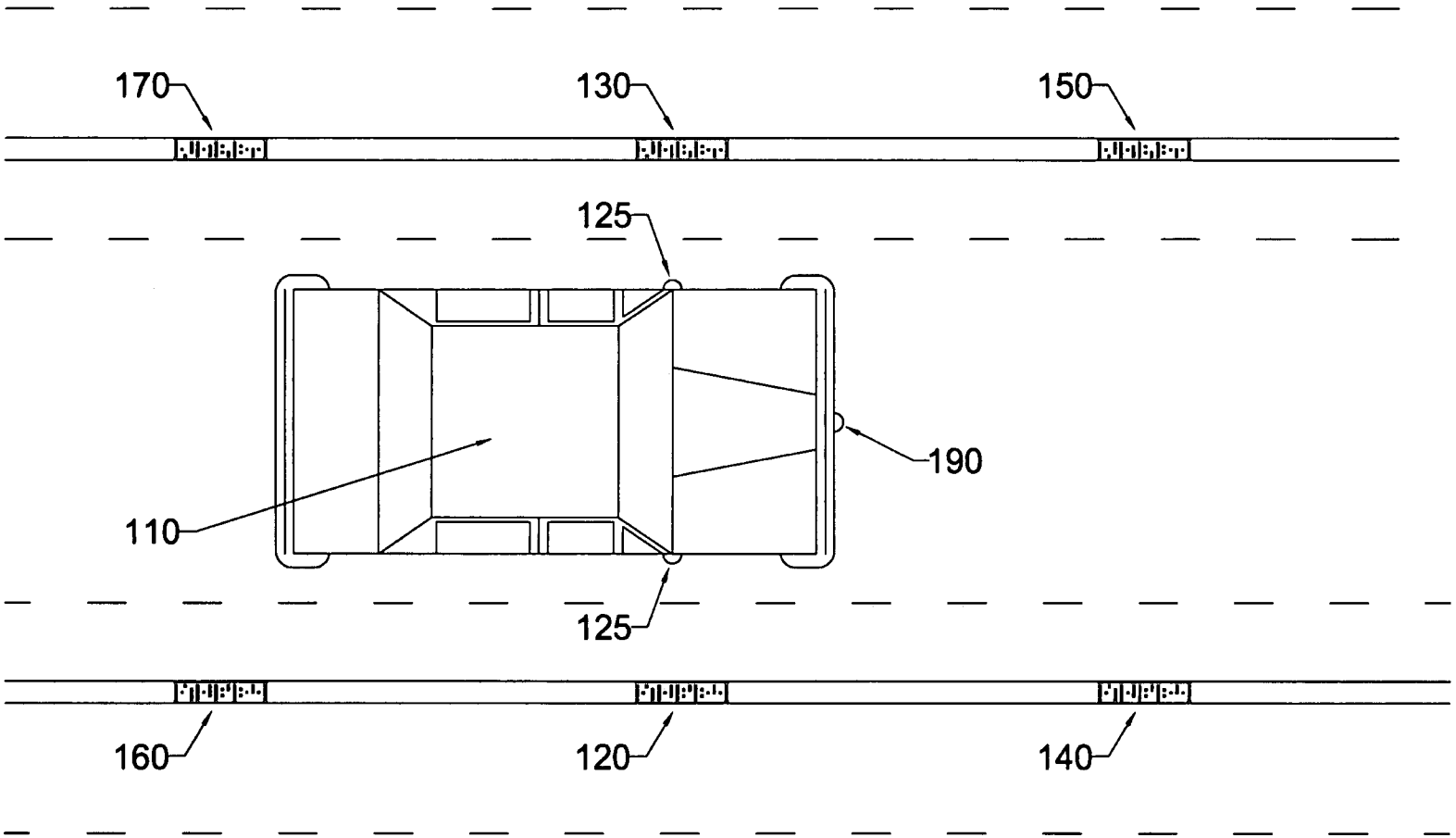
FIG. 1 is a schematic illustration of a vehicle when scanning coded messages, according to one embodiment of the invention.

The present invention relates to a system for reducing driving accidents by providing to a driver and/or to his vehicle, in advance, information of upcoming road characteristics that may lead to potentially dangerous situations if the driver does not react properly in good time. Road parameters include various curves, road tilt, road margins, road signs, markings on the road, signs and posts and any other information required to alert the driver of upcoming situations in the road. Driving conditions include the state of the road resulting from weather conditions, such as rain, snow, and ice affecting contact between the vehicle and the road, and other conditions such as fog, light conditions, etc., affecting visibility. These characteristics are collected and analyzed by the system to provide the driver with an early indication of a potential risk involved with his current driving. The driver may use this indication to reduce driving risks.

The proposed system acts like a co-driver in racing cars, whose job is to alert the driver of upcoming situations in the road which may be potentially hazardous to the current manner of driving. This information is provided in advance, i.e. within minutes or seconds, as required, before the driver needs to respond to the specific upcoming situation. For example, the driver is alerted to an upcoming curve in the road, or merging traffic, or a stop sign, or any other characteristic of the road that requires a driver to react. According to another example, the driver is alerted when the vehicle has taken a direction that leads towards the shoulders of the road and off the road, which may be caused by the driver falling asleep. In this way, the system alerts the driver that his current manner of driving may, within seconds, become potentially dangerous in view of the direction of traveling or changes that are about to take place in the parameters of the road and driving conditions, any of which may result in an emergency situation unless the driver takes immediate action. Alternatively, this information may be output directly to the vehicle for display or for action by the vehicle, itself.

The system collects the information from coded messages disposed along the road, in place of, or on the divider lines defining lanes or road shoulders. The coded messages represent the characteristics of the road up ahead and changes thereof. A sensor or other device that is mounted on the motorcar reads these encoded messages, decodes them and outputs or otherwise makes the information which they contain available to the system. These messages include upcoming traffic signs and additional information relevant to the driving, such as, a distance to an upcoming curve or an intersection. Also, these messages can be used by the system to determine the traveling direction of the motorcar relative to the direction of the road and alert the driver if it concludes that the change in direction is not compatible with the road parameters. Thus, the system may provide the driver with warnings that his manner of driving is not suitable for the characteristics of the upcoming section of the road, or the driving conditions of the road, and irregularity in direction of travel relative to the road characteristics. For example, the speed of the vehicle might be too high for safely maneuvering an upcoming curve in the road having a certain tilt. The system may also indicate to the driver the level of risk of his current driving in view of the road up ahead and recommend a change in manner of driving, such as, slowing down at a given distance away from the curve. Further, the system may provide the driver with an early warning that the vehicle has taken a traveling direction that may cause it to go off the road or unintentionally cross lanes, causing dangerous situations. It will be appreciated that the system may be preset by the driver within certain limits to accommodate his individual abilities to react to speedy change of characteristics of the road. For example, a potentially hazardous situation for an ordinary driver may be a trivial situation for a professional driver. However, it will be further appreciated that a given curve and tilt cannot be negotiated by even a skilled driver beyond a certain speed.

The system preferably provides for optical scanning of the coded messages at high driving speed, even under blurry conditions, such as in darkness or rain.

Referring now to FIG. 1, there is shown a schematic illustration of a top view of a vehicle having a sensor or other device for scanning coded messages, according to one embodiment of the invention. A vehicle 110, driving along a road, has two sensors 125 disposed on the sides of the vehicle, such as near the mirror, as shown. Each sensor 125 may be a video or CCD camera, or any other sensor that can scan physical objects or road surface markings, placed for instance on the divider lines between traffic lanes or along the shoulders of the road. Examples of such road surface markings are shown as coded messages 120, 130, 140, 150, 160, 170 in FIG. 1. These coded messages may hold a variety of road information, including road characteristics and any other information needed to alert the driver of an approaching section of the road which requires action by the driver. As can be seen, these coded messages are disposed at intervals, preferably every few meters, permitting several such symbols to be scanned per second, so as to provide continually updated information to the present system. The symbols can be of any length and preferably are selected according to their distance from the scanner mounted on a vehicle and the angle at which they are scanned.

It will be appreciated that the scanned information is processed by the system preferably to account for the angle of scanning, so as to properly decode the messages. It may be further appreciated that the messages may be disposed at various locations on or along the road and the scanning sensors may be mounted at various locations on the motor vehicle.

The messages may be printed on the road by a dedicated computerized vehicle, aided by GPS and computerized maps. It will be appreciated that the coded messages may include information of the exact location of the message along the road and the system according to a preferred embodiment can utilize this information to send, via wireless communication, as known, indications of the precise location of the vehicle along the road at any time.

An additional sensor 190 can be mounted on the front end of a vehicle for collecting information of objects to which the vehicle is getting nearer. Sensor 190 may be a laser type sensor or any other suitable sensor, as known. The system may also collect and utilize information relating to the state of the vehicle, such as its speed or acceleration, operation of its turning signals or its brakes, etc.

The vehicle may further include sensors for collecting information relating to the driving conditions, such as humidity, temperature, visibility, light, frictional contact with the road, etc., and the system may utilize this information, combined with all other collected information as described herein, for determining the optimal manner of driving at any time in any location along the road. According to one embodiment of the invention, the system may be adapted and configured to automatically collect the information relating to the state of the vehicle and/or the driving conditions and according to another embodiment, the driver may manually initiate the collection of such the information by the system, as by on/off switches.

The code, according to one embodiment of the present invention, represents information as the ratio between the length of each symbol of the code and the length of a reference symbol, and the position of the symbol in relation to either end of the reference symbol. The code can be decoded using a decoding key. This particular code language was developed to address the need of the system to read the messages by optical scanning in real time, while driving at high speeds.

According to one embodiment of the present invention, the code consists of 13 symbols. One of these symbols preferably indicates the beginning of the coded information. The symbols utilized can be of any size, shape, or color as long as they have a clearly defined top and bottom to permit an accurate height measurement. They can be spaced apart a predetermined distance from one another, or non-spaced (i.e., adjacent one another) in any selected manner and can be implemented in any way (e.g., painting, impression, lighting, projection onto a screen, etc.) as long as there is a high enough contrast between the symbols and the background to allow differentiation between consecutive symbols during high-speed scanning. By combining the different symbols, spaced and adjacent, it is possible to express substantially any textual letter and any number in any language. In a preferred embodiment of the invention, the symbols are spaced bars of different heights.

Figure 2A:
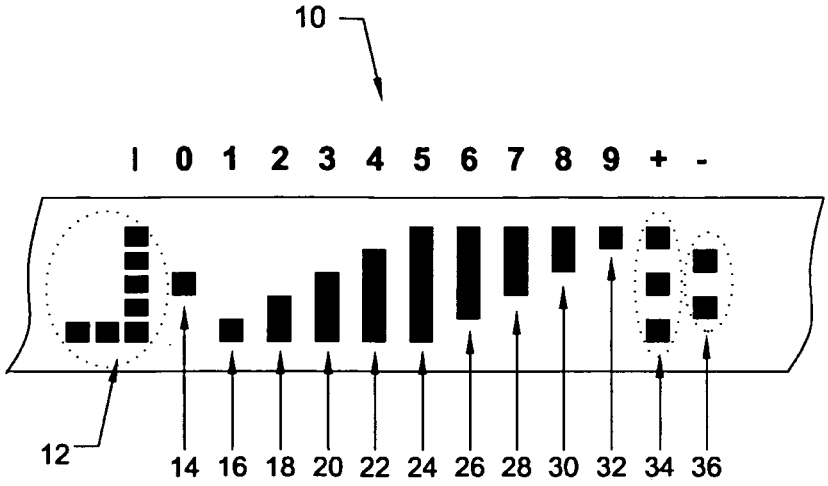
FIGS. 2*a* and 2*b* are schematic illustrations of a coding key and an encoded message, respectively, in accordance with one embodiment of the present invention.
Figure 2B:
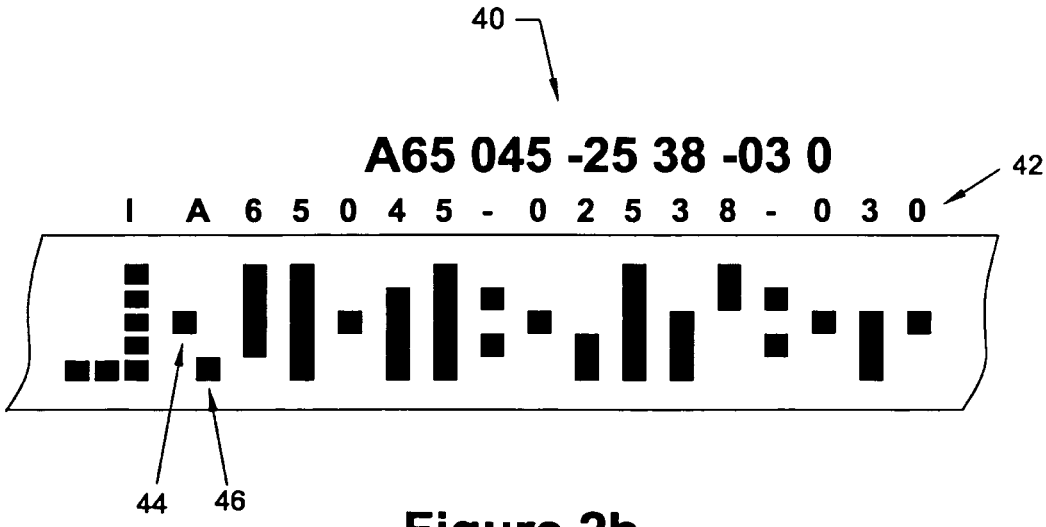

Referring now to FIGS. 2*a* and 2*b*, there are shown schematic illustrations of one example of a decoding key 10 and an encoded message 40, respectively, in accordance with one embodiment of the present invention. As seen in FIG. 2*a*, the decoding key consists of rectangular bars of different heights and evenly spaced a pre-selected distance from one another. In this embodiment, the first symbol 12 is a reference symbol and defines the maximal height of the symbols and the top and bottom of the code line. Each symbol's height is measured with relation to the reference symbol. Symbols 14, 16, 18, 20, 22, 24, 26, 28, 30 and 32 are symbols that express, in this example, numerals from 0 to 9. Symbols 34 and 36 express the textual symbols + and −, respectively. Two adjacent consecutive symbols (shown in FIG. 2*b*) express a font which is set in a numerical order according to the alphabetical order. For example, in English A=1, B=2 etc. It will be appreciated that many variations and modifications may be made to the proposed code language.

Figure 3:
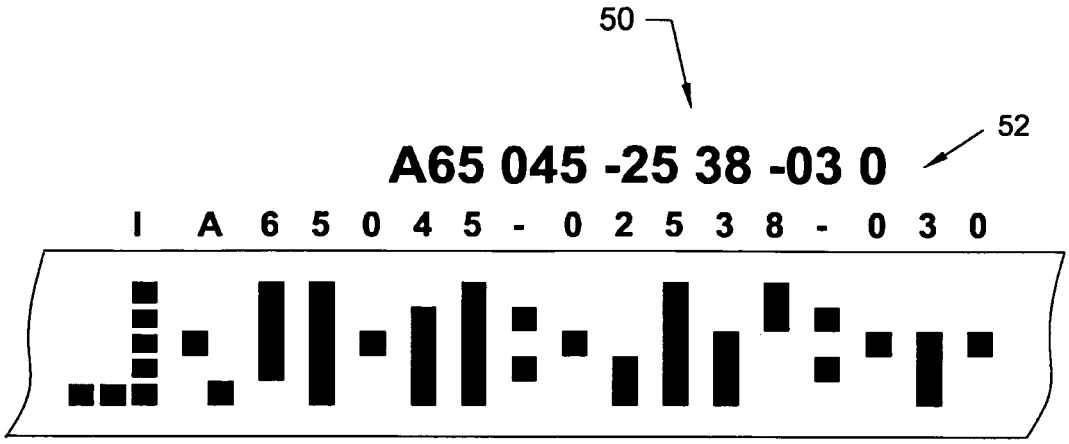
FIG. 3 is a schematic illustration of the first step of decoding the message example shown in FIG. 2, in accordance with one embodiment of the present invention.

Referring now to FIG. 2*b* there is shown a schematic illustration of a coded message 40 according to one embodiment of the invention. This coded message can be decoded using decoding key 10 of FIG. 2*a*. The result of decoding each of the rectangular bars of message 40 shown in FIG. 2*b* using decoding key 10 is: "01-65045-02538-030" (marked 42). However, since symbols 44 and 46 are not spaced apart from one another, they do not represent two numerals "0 1" but, rather, a single letter, here shown as the letter "A". Similarly, "02" may represent "B", etc. Therefore, as shown in FIG. 3, the first step of decoding the coded message 50 results in: "A65045-02538-030" (marked 52).

It is a particular feature of the invention that the code can be read by means of a static scanner or a scanner moving in a direction perpendicular to the height of the code, even at great speed, such as 50 meters per second.

The second step of decoding of the message shown in FIG. 3 involves decoding the letters and numbers to an understandable message according to preset rules. In the illustrated embodiment, coding and decoding is from left to right. For example, "A65" represents a turn while the numerals that follow "045" represent the number of meters to the turn divided by 10; the minus sign an numerals "−025" that follow represent the angle of turn; the numerals "38" that follow represent the radius of an upcoming turn in the road measured in meters; the next minus sign represents a drop of the road; the following numerals "03" represent the angle of slope, and the last numeral "0" represents angle of tilt. Thus, this message informs the system that 450 meters ahead the driver needs to turn 25 degrees to the left, at a radius of 38 meters, with a sloping road of 3 degrees, and a tilt of 0 degrees. The system decodes and analyzes the message and informs the driver in real time about the upcoming situation and will alert the driver if his current driving is not suitable to the upcoming situation. The system reads a plurality of such messages every second, thus the information received by the system is updated in real time, and the driver gets the information and indications early enough to properly react on time to the upcoming situation.

In addition to informing the driver of anticipated changes in the road, the system is capable of providing a description of the driving path. For example, the messages of the path may include information relating to the type of the road, its width, number of lanes, permitted direction, permitted speed, and general direction (South, North, etc.) of the current driving. In addition, the system can provide the driver in advance information relating to the upcoming location of various services, such as of parking lots or petrol stations. These kinds of messages may also include the number of the road, distance to a junction, current location on the way, definition of the service, and the distance to the service.

According to one embodiment of the invention, the system analyzes the scanned objects, signs and messages to provide an indication of the level of driving safety or risk of the vehicle at any point along the road and provides the driver with recommendations of proper driving. The processor continually processes the scanned messages and other various types of information as described herein and provides the driver with an indication of his manner of driving relative to the optimal manner at each location along the road. The speed of the vehicle can be computed using the speed of scanning of the objects or road markings spaced at a known distance from each other, thus correcting computed values by comparing to the internal speedometer of the vehicle. Further, the measured angle of scanning of consecutive markings can also be used by the system to detect that the vehicle is approaching the boundaries of a lane or a shoulder of the road and is about to cross into an adjacent lane or go off the road, respectively. Thus, the system may determine if such deviance from the proper traveling direction may create a potentially dangerous situation and alert the driver accordingly in various known ways.

Figure 4:
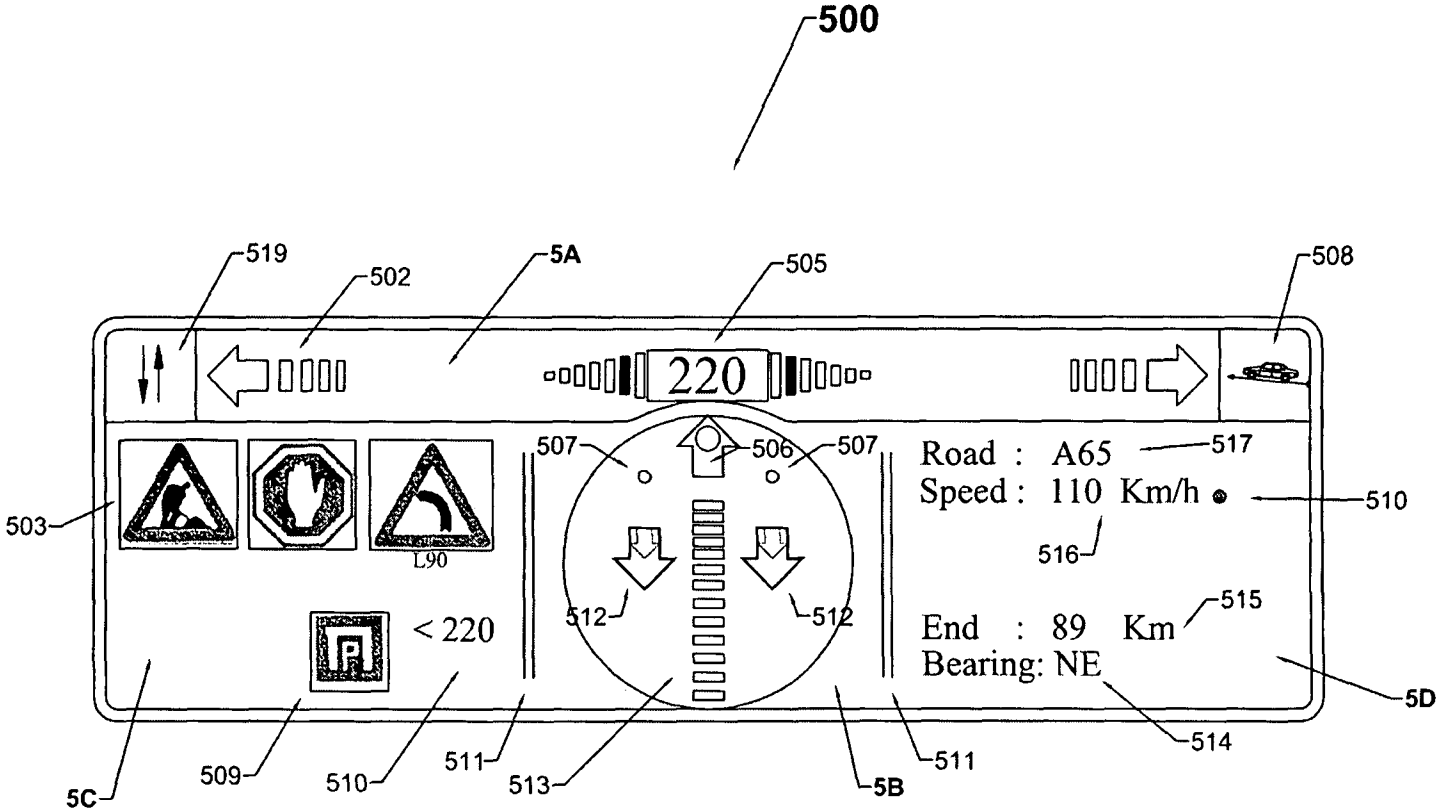
FIG. 4 is a schematic illustration of a driver control panel, according to one embodiment of the invention.

Referring now to FIG. 4, there is shown is a schematic illustration of a driver control panel 500, according to one embodiment of the present invention. The control panel 500 of the system provides information and recommendations to the driver, after analysis of the scanned information, and various other types of information as described herein. The central zone of the control panel, marked 5B, contains visual indications to the driver, supporting the basic level decisions of the driver, that is, steering wheel to the right or to the left, accelerate or decelerate. If desired, audible indications may be provided to alert the driver in addition to or instead of the visual indications. Since most accidents are caused by incorrect or late performance of one of these four activities, the ability of the system to receive relevant information in advance and quickly analyze it and recommend one of these basic activities can prevent many accidents.

Gradient 513 in zone 5B shows the relationship between actual speed and suitable speed in relation to an approaching change in a parameter of the road. For example, if the upper strips of Gradient 513 are lit red, this indicates to the driver that he is going too fast, i.e., towards an intersection or turn, and must slow down. Two identical arrows 512 pointing downwards indicate to the driver when he must decelerate or apply the brakes. Their size indicates the urgency, and a vocal or other audible indication may be activated in extreme situations. If these arrows are displayed upwards, then the driver is recommended or instructed to accelerate.

Two lamps 507 in zone 5B notify the driver that the vehicle is changing its lane. For instance, when the right lamp is on and the left lamp is off the vehicle is in the right lane in a double lane road. A compass-like indicator 506 in zone 5B shows the recommended steering wheel direction. For example, when the system detects that the vehicle is heading out of its lane, this arrow turns to the opposite direction to the appropriate extent. Two pairs of lines 511 may be provided which will turn on and blink, preferably together with a vocal warning, when the system determines that a forbidden or potentially hazardous change of lane is about to take place, or the vehicle is dangerously approaching the shoulder of the road. However, no such indications will be provided by the system when such change of lane or traveling direction are expected, in view of the information provided to the system.

According to another embodiment of the present invention, the advance information collected by the system as described above can be analyzed, for example, by a computer controlling the car, and used to automatically adjust the vehicle's acceleration, braking and steering to avoid a potentially dangerous situation from arising by sending signals to the vehicle according to the analysis of the advanced information. It will be appreciated that this system can be used to control an automatically driven vehicle.

The upper zone of the control panel, indicated 5A, provides the driver with information regarding an approaching situation, so that the driver can decide on a suitable reaction, in addition to the instructions and recommendations provided by system and indicated in zone 5B, described above. A series of indicators 503 in zone 5A, preferably international road signs or other graphical illustrations, indicate an approaching parameter of the road. As shown in zone 5A of FIG. 4, a distance indicator 505 displays the distance to the next parameter (for example 220 meters). According to a preferred embodiment, there are provided several distance indicators, each referring to a different parameter of the road up ahead. Further, the direction of an upcoming curve may be indicated by a colored lit gradient arrow 502. The strips of gradient arrow 502 indicate whether the upcoming bend is a sharp or moderate bend in the road, and the level of danger of maintaining the current speed of the vehicle. The slope of the upcoming portion of the road may be indicated by an illustration of a sloping vehicle, as shown at 508.

A zone 5C may provide information of approaching services. For example, an approaching parking lot 509 is shown in FIG. 4. An indication of the distance 510 to the service (here 220 meters) may also be provided.

Additional general information may be provided, as shown in zone 5D. For example, the name of the road 517 may be indicated ("A65" in the example shown), the permitted speed 516 on this road (110 km/h), the distance 515 to the end of the current road (89 Km), and the general direction of travel 514 ("NEWN-North East). A lamp 520 will turn on if the actual speed exceeds the permitted speed. Additional information regarding the parameters of the road, such as the type of road and number of lanes (bi-directional one lane) may also be provided 519.

The system can store driving information for additional applications, such as for analyzing the behavior of the driver during real time driving or during an accident or at the scene of a narrowly missed accident. To that end, the system may be used as a "black box", as known. A driver can review his manner of driving including the errors which he has committed during driving. The information collected by the system according to the present invention may also be used by the driver's employer to review his employee's driving. The authorities may also use this information to analyze the driving manner of many users of a particular road and provide proper warning signs and supervision in dangerous parts of the road or detect dangerous drivers.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A system for providing a vehicle in advance with road information, the system comprising:

at least one visual sensor mounted on said vehicle reading, in real time while said vehicle is driving along a road, encoded visual markings, disposed along the road, said visual markings including information of at least one road characteristic of an upcoming section of said road; and a processor, coupled to said visual sensor, automatically processing said read visual markings and automatically outputting visible or audible indications of said information of said road characteristics to a driver driving the vehicle, in advance of said vehicle reaching said section of said road; wherein said code comprises:

a reference symbol having a top and a bottom, said reference symbol top and bottom defining opposing limits of a code line;

at least one graphic symbol representing encoded information regarding a static road condition, for processing by a vehicle moving along a road, disposed between said top and said bottom of said code line;

said information being represented by a ratio of a height of each said graphic symbol to the height of said reference symbol and by each said symbol's position relative to said opposing limits of said code line; and wherein said reference symbol indicates a beginning of encoded information and a direction for decoding said encoded information; and, wherein when one said graphic symbol is spaced apart from another of said graphic symbols in said code line, said one symbol represents one alphanumeric symbol; and when two of said code symbols on said code line are not spaced apart from one another, said two symbols together represent another alphanumeric symbol.

2. The system according to claim 1, wherein said visual sensor comprises a camera selected from the group including a video camera and a CCD camera.

3. The system according to claim 1, wherein said visible indications comprise a display, coupled to said processing device, for displaying said information to said driver of said vehicle.

4. The system according to claim 1, wherein said audible indications comprise audible indications initiated by said processor.

5. A method for indicating to a driver upcoming situations in a road which may be potentially hazardous to a vehicle on the road, the method comprising:

reading in real time, by a visual sensor on a vehicle driving along a road, encoded visual markings along the road, said visual markings including information of at least one road characteristic of an upcoming section of said road;

automatically processing in a processor coupled to said visual sensor said read visual markings to decode said information to digital information; and automatically outputting, by said processor, visible or audible indications of said digital information of said road characteristics to a driver driving the vehicle, in advance of said vehicle reaching said section of said road; wherein said code comprises:

a reference symbol having a top and a bottom, said reference symbol top and bottom defining opposing limits of a code line;

at least one graphic symbol representing encoded information regarding a static road condition, for processing by a vehicle moving along a road, disposed between said top and said bottom of said code line;

said information being represented by a ratio of a height of each said graphic symbol to the height of said reference symbol and by each said symbol's position relative to said opposing limits of said code line; and wherein said reference symbol indicates a beginning of encoded information and a direction for decoding said encoded information; and, wherein when one said graphic symbol is spaced apart from another of said graphic symbols in said code line, said one symbol represents one alphanumeric symbol; and when two of said code symbols on said code line are not spaced apart from one another, said two symbols together represent another alphanumeric symbol.

6. The method according to claim 5, wherein said step of outputting a visible indication includes displaying said information to said driver of said vehicle on a display inside said vehicle.

7. The method according to claim 5, wherein said step of outputting an audible indication includes providing audible indications initiated by said processor.

8. The system according to claim 1, wherein said visual markings representing said information are disposed on divider lines on the road.

9. The method according to claim 5, further comprising determining, in said processor, a current manner of driving of the vehicle; and wherein said step of outputting comprises automatically outputting said information, relative to said current manner of driving, to said driver of the vehicle, in advance of reaching said section of said road.

* * * * *